United States Patent [19]

Evans, III

[11] Patent Number: 4,997,046

[45] Date of Patent: Mar. 5, 1991

[54] FLUE FIRE EXTINGUISHER

[76] Inventor: Harry A. Evans, III, HCR 80, Box 450, Cuba, Mo. 65453

[21] Appl. No.: 409,768

[22] Filed: Sep. 20, 1989

[51] Int. Cl.[5] ..... A62C 3/00

[52] U.S. Cl. ..... 169/54; 169/56; 169/65

[58] Field of Search ..... 169/57, 60, 65, 9, 19, 169/26, 54, 56, 61

[56] References Cited

U.S. PATENT DOCUMENTS

| | | | |
|---|---|---|---|
| 4,260,023 | 4/1981 | Irmscher | 169/57 |
| 4,341,267 | 7/1982 | Lagasse | 169/54 |
| 4,384,617 | 5/1983 | Mueller | 169/57 |
| 4,393,941 | 7/1983 | Stevens | 169/70 |
| 4,469,183 | 9/1984 | Hayes | 169/46 |
| 4,481,933 | 11/1984 | Sawtelle | 169/51 X |
| 4,519,458 | 5/1985 | Kroetter | 169/56 |
| 4,646,847 | 3/1987 | Colvin | 169/49 |
| 4,664,197 | 5/1987 | Leduc et al. | 169/26 |
| 4,736,801 | 4/1988 | Grewell | 169/52 |

FOREIGN PATENT DOCUMENTS

| | | |
|---|---|---|
| 1161805 | 2/1984 | Canada . |
| 1200796 | 2/1986 | Canada . |

*Primary Examiner*—Joseph F. Peters, Jr.
*Assistant Examiner*—Virna Lissi Mojica
*Attorney, Agent, or Firm*—Polster, Polster and Lucchesi

[57] ABSTRACT

An automatic mechanical flue fire extinguishing system includes a pressurized container of fire-extinguishing material which communicates with a thermally sensitive valve installed in a flue pipe of a wood stove or the like near the bottom of the flue pipe. When a predetermined temperature is reached, a fusible metal disk within the valve melts, opening the valve and releasing the fire extinguishing material into the flue pipe, thereby extinguishing the flue fire. The fire extinguishing system may also be manually operated.

8 Claims, 2 Drawing Sheets

FLUE FIRE EXTINGUISHER

BACKGROUND OF THE INVENTION

The present invention relates to systems for automatically detecting and extinguishing flue fires by completely mechanical means.

Many homeowners have added wood stoves or fireplaces to their homes to supplement their primary heating source or even to be the main source of heat. These systems incorporate flue pipes to exhaust combustion gases and by-products to the atmosphere. As the stove is used, unburned materials such as wood tar build up on the interior of these flue pipes. This is especially so when green wood is burned or the fire is dampened down in moderate weather. If these unburned materials are not cleaned out frequently and are allowed to build up, they may easily be ignited, creating a fire in the flue which may readily spread to the rest of the house.

Both manual and automatic devices and systems have been invented to combat flue fires. Manual systems require that an operator be aware of the fire and be available to activate the system. But when a wood stove is used to heat a house, there may not always be someone available to watch the stove. Further, some of these require excessive time and in some cases extra equipment. For example, U.S. Pat. No. 4,393,941 to Stevens requires the operator to mount a ladder against the house so that he can drop a garden hose, which is attached to an outdoor spigot, down the chimney.

Automatic systems fall into two catagories: electrically operated and mechanically operated. The electrically operated systems obviously require a source of electricity which may not be available at the time of the fire. The wires running to the system may have been destroyed by spreading fire, the electricity in the house may have been knocked out by fire, or the loss of electricity may be the reason the wood burning stove is being used in the first place. If the electricity went out before the fire, that may be the reason why the fire in the stove has been stoked up sufficiently to cause the flue fire as well. If a battery pack were used at the source of electricity, the owner would have to periodically replace or recharge the batteries so that the system remains operational.

Mechanical systems tend to use fusible links and/or tend to be located on the roof of the house. Both types are difficult to reset. Fusible links must be resoldered with the appropriate solder or replaced and reattached so that the system is once again operational. This is even more difficult when the system is located within the upper part of the chimney. Further, systems that are located in the roof or in the upper part of the chimney are subject to the extremes of weather which may affect their ability to operate. Significantly, in roof based systems the fire extinguishing material is far away from the source of the fire. The bottom or base of the flue pipe is where combustion by-products accumulate and where the flue fire is most likely to occur. The by-products accumulate near the bottom of the flue due to the expansion and contraction of the flue during use which causes the particles to flake off and fall to the bottom of the flue. In a roof based system, the updraft within the flue, quite strong during a flue fire, may carry the extinguishing material out of the chimney before it has a chance to reach the fire.

SUMMARY OF THE INVENTION

An object of the present invention is to automatically detect and extinguish flue fires.

Another object of the present invention is to provide a flue fire extinguisher which is easily reset.

Yet another object of the present invention is to provide a flue extinguisher which will place fire extinguishing material close to the source of the fire.

These and other objects will become apparent to those skilled in the art upon examining the following description in light of the accompanying drawings.

In accordance with the objectives there is provided a container of pressurized fire extinguishing material that is connected to a thermally sensitive valve. The valve is inserted near the bottom of a flue pipe of a wood stove or the like.

The thermally sensitive valve comprises a hollow sleeve which surrounds a retaining plug and a fusible disk. The disk melts at a predetermined temperature. A plunger is disposed in the opposite end of the sleeve from the retaining plug and the fusible disk and extends outwardly therefrom. A hollow cap in fluid communication with the pressurized fire extinguishing material, and through which the plunger extends, is secured to the sleeve. The plunger allows for manual operation of the valve.

The fire extinguishing system may also have a pressure sensitive alarm connected to the pressurized container.

When a fire occurs in the flue, the fusible disk melts. With the disk no longer able to hold the retaining plug in place, the pressure of the fire extinguishing material forces the retaining plug out of the sleeve into the flue. The fire extinguishing material then enters the flue under pressure and puts out the fire.

If desired, the valve can be operated manually by pushing the plunger inwardly. The plunger pushs the retaining plug against fusible disk, forcing the disk to fall into the flue. Fire extinguishing material then flows through the system under pressure and puts out the fire.

BRIEF DESCRIPTION OF THE DRAWINGS

Similar reference characters indicate similar parts throughout the several views of the drawings.

DESCRIPTION OF THE PREFERRED EMBODIMENT

Figure 1:
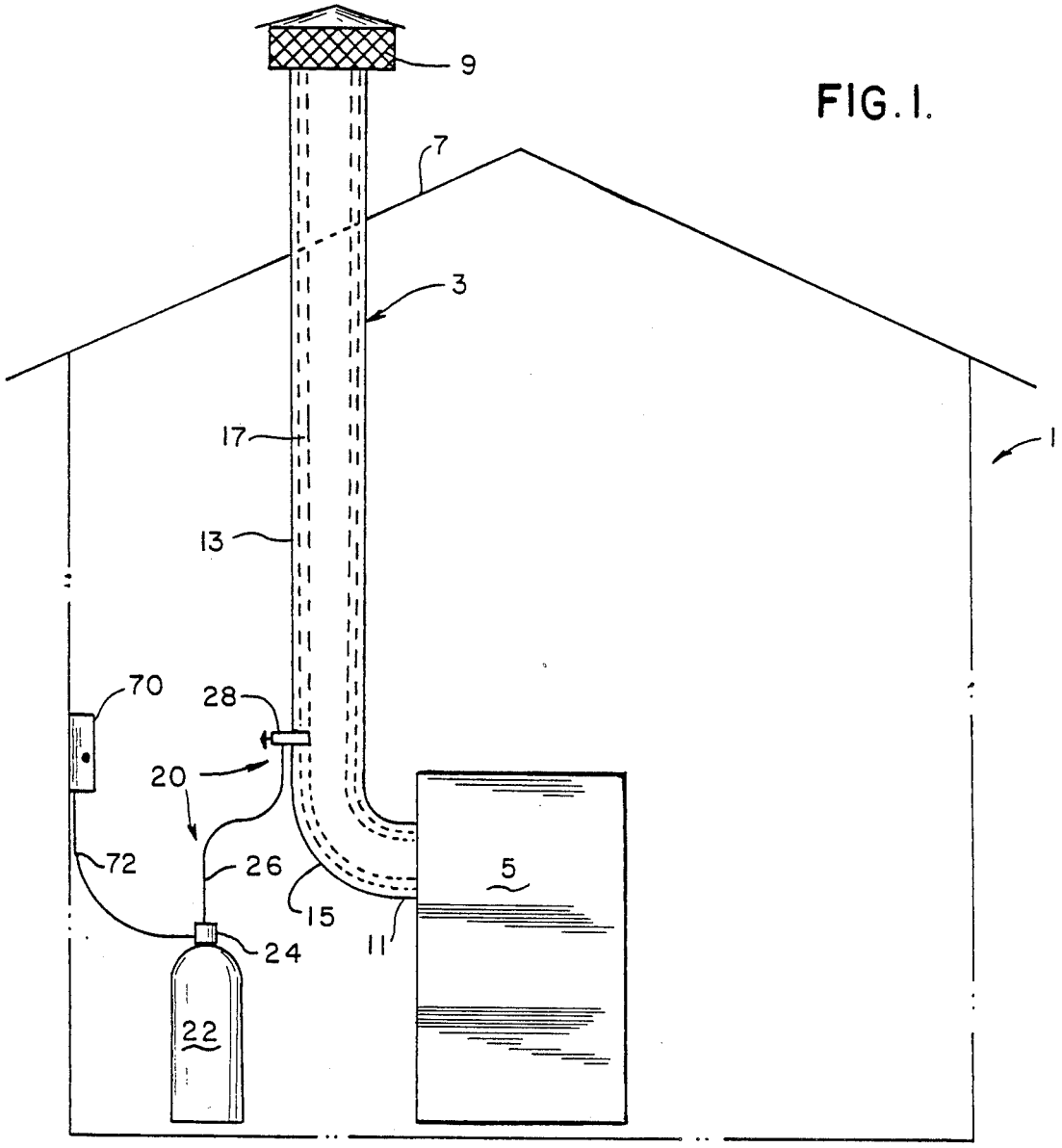
FIG. 1 is a schematic view of the fire extinguishing system of the present invention.

Referring initially to FIG. 1, a dwelling 1 is shown having a chimney or flue 3 which is capped a by spark arrester 9. The flue 3 extends from a wood stove or the like 5 up through the roof 7 of the house 1. The flue 3 includes a horizontal section 11 and a vertical section 13 connected by an elbow 15. The flue is preferably a triple walled flue as shown at 17.

An automatic fire extinguishing system 20 of the present invention includes a pressurized container 22 having therein a fire extinguishing liquid or powder material. Atop pressurized container 22 is a quick disconnect assembly 24, which opens when a flexible hose 26 is attached to it. The hose 26 is attached at its other end to a thermally sensitive valve 28.

The valve 28 is installed (as described below) near the bottom of vertical section 13 of flue pipe 3, where most of the combustible material within the flue will accumulate. Thus, the valve is near where a fire will most likely originate, which maximizes the ability of the fire extinguishing system to put out the fire.

Figure 2:
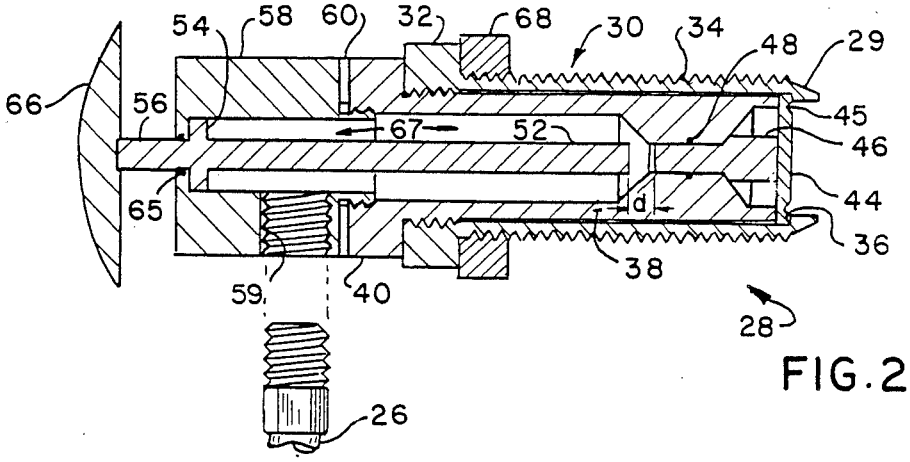
FIG. 2 is a cross-sectional view of the thermal sensitive valve of the present invention.

Although valve 28 must be in fluid communication with the interior of flue 3, it preferably should not interfere with conventional cleaning of the flue. For this reason valve 28 does not extend far into the flue and its end is tapered as can be seen at 29 (FIG. 2). This tapered shape does not interfere with or otherwise obstruct conventional cleaning of the flue.

Figure 3:
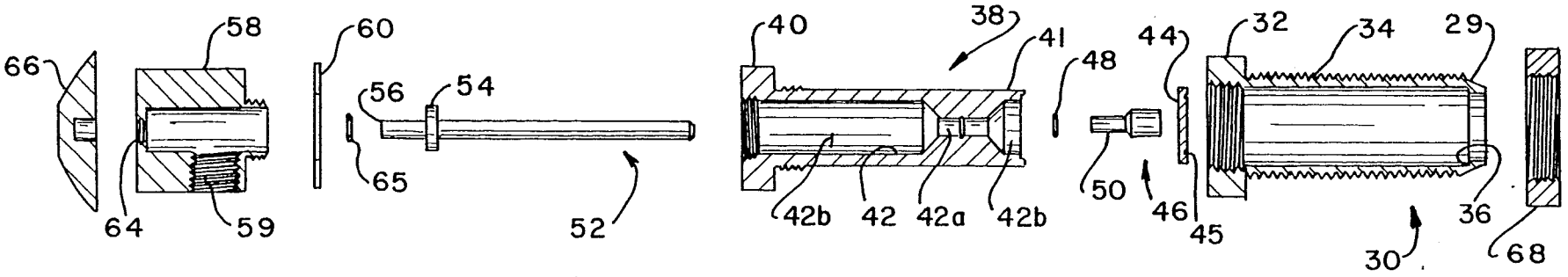
FIG. 3 is a exploded cross-sectional view, on a smaller scale, of the valve of FIG. 2.

As shown in FIGS. 2 and 3, valve 28 includes a housing 30 comprising an internally threaded flange 32 and an exteriorly threaded body 34 extending from the flange. Body 34 terminates in tapered end 29. The inside edges of tapered end 29 define a lip 36 which holds in place a fusible disk 44 which melts at a predetermined temperature. Fusible disks are well known. The particular temperature at which disk 44 melts is selected so that the disk melts only during a flue fire, not during normal operation of the stove. Disk 44 has a ring-shaped concentric groove 45 which provides a preferential ring of failure for disk 44. Disk 44 has a diameter substantially the same as the inner diameter of housing 30. The groove 45 is positioned on disk 44 such that the groove is not obstructed by lip 36.

Valve 28 includes a sleeve 38 having an internally threaded flange 40 and a body portion 41 having exterior threads thereon near the flange. Sleeve 38 is sized so as to fit inside housing 30, where it is secured in place by the interior threads of housing flange 32 matingly engaging the exterior threads on sleeve body 41. The interior surfaces 42 of the sleeve 38 define a hour-glass shaped hollow having a narrow portion **42*a* and two wider portions 42*b* (FIG. 3). Prior to inserting sleeve 38 into housing 30, a retaining plug 46 having a first O-ring 48 around its narrower end 50 (FIG. 3) is inserted into the forward end of body 41 of the sleeve. A plunger 52 having a flange 54 near its back end 56 is inserted into the flanged end 40 of sleeve 38**.

A cap 58 is threadedly connected to sleeve 38. Cap 58 has an internally threaded port 59 for connection to hose 26 and a hole 64 at its back through which the rear portion 56 of the plunger extends. A second O-ring 65 is placed within hole 64 so that there is a tight fit between cap 58 and rear portion 56 of plunger 52. The plunger's protruding end 56 is covered by a knob 66.

A washer 60 is placed between cap 58 and sleeve 38. The interior surfaces of sleeve 38 and cap 58 combine to form a pressure chamber 67.

When the plunger flange 54 rests against the back of cap 58, the plunger extends nearly to retaining plug 46. When the plunger is so positioned, the protruding portion 56 of the plunger 52 is greater in length then the distance "d" between the tip of the plunger and the retaining plug 46. This allows for manual operation of valve 28.

To install the system, a hole is cut into the existing triple walled flue pipe 3 just above the flue elbow 15. Valve 28 is screwed into the hole in the flue pipe 3 by means of the threads on housing body 34. The valve 28 is positioned with threaded port 59 facing downwardly. A lock nut 68, threadedly engaged with the exterior of housing body 34, is tightened against the flue pipe 3 to secure the valve assembly 28 in place. The hose 26 is connected to valve 28 by means of port 59 and to the quick disconnect assembly 24 of container 22. At this point the fire extinguishing material is released into pressure chamber 67, but retaining plug 46 and fusible disk 44 prevent it from passing prematurely into the flue.

An optional pressure sensitive alarm 70 (FIG. 1) may also be connected to system 20. The alarm is connected to quick disconnect assembly 24 by a second flexible hose 72.

When a fire starts in the flue 3, disk 44 melts once the melting point of the disk is reached. The pressure of the extinguishing material in the chamber 67 then forces the retaining plug 46 (and any remnants of disk 44) into the flue 3. The extinguishing agent floods the entire interior of stove 5 and flue pipe 3, extinguishing the fire. The extinguishing agent is released until container 22 is depleted to assure that the fire is extinguished.

System 20 may also be operated manually. An operator can push plunger knob 66 instead of waiting for disk 44 to melt. When knob 66 is pushed, the plunger 52 forces retaining plug 46 forward. Disk 44 preferentially breaks along groove 45 and the central portion of disk 44 is pushed by the plunger and retaining plug into the flue 3. The end of the plunger is pushed into the reduced area **42*a* of sleeve 38, blocking the flow of the extinguishing material. The pressure of the extinguishing agent in chamber 67 is exerted against flange 54 of the plunger 52, which pushes the plunger 52 from the reduced area of sleeve 38 back against the cap 58. The pressure of the fire extinguishing material expels the retaining plug 46 into the interior of the flue pipe 3. The extinguishing agent is then released into the interior of flue 3 and stove 5** to extinguish the fire.

After the fire has been put out, system 20 is easily reset. Hose 26 is disconnected from valve 28 and the quick disconnect assembly 24. The pressurized container 22 can be recharged at a local fire station. Sleeve 38 is unscrewed from the housing 30. A new retaining plug 46 and O-Ring 48 are inserted into the sleeve 38. A new thermally sensitive disk 44 is inserted into housing 30 against lip 36. The sleeve assembly is then screwed back into housing 30.

I claim:

1. A mechanically operable flue fire extinguisher for use in extinguishing fires of combustion by-products in a flue connected to a wood stove or the like, said fire extinguisher comprising:

a. a pressurized container of fire extinguishing material;

b. a thermally sensitive valve installed in the flue pipe near the bottom of said flue pipe, thereby positioning said valve near the source of a flue fire, said valve including a pressure chamber and a fusible disk which melts at a predetermined temperature;

c. a hose secured at one end to the thermally sensitive valve and having its interior in fluid communication with the pressure chamber; and d. hose connecting means attached to the top of said pressurized container so that when said hose is connected to said container, said container is opened, allowing said fire extinguishing material to flood said pressure chamber in the thermally sensitive valve;

e. said pressure chamber being disposed so as to exert pressure on the fusible disk such that melting of the fusible disk causes fire extinguishing material to pass under pressure from the pressure chamber into the flue.

2. The extinguisher of claim 1 wherein said fusible disk has a concentric groove near its outer perimeter.

3. The extinguisher of claim 1 wherein said valve further comprises a retaining plug positioned between said disk and the pressure chamber and a plunger positioned in the pressure chamber adjacent said plug, said plunger having a portion communicating with the exterior of said valve, said plunger having a throw sufficiently long to cause the retaining plug to force the disk out of the valve when the plunger is actuated, thereby allowing for manual operation of said fire extinguisher.

4. The fire extinguisher of claim 3 wherein said fusible disk has a preferential line of breaking disposed along its outer perimeter so that the fire extinguisher may be manually operated by pushing said plunger inwardly, causing said retaining plug to break the disk along the preferential line of breaking and to push said inner portion of the fusible disk into said flue, thereby allowing said fire extinguishing material to flow through said valve to flood said flue and stove, extinguishing said fire.

5. The extinguisher of claim 1 wherein said extinguisher further comprises a pressure sensitive alarm, said alarm being connected to said connecting means via a hose such that when said container is emptied during a fire, the pressure within said container will drop and said alarm will sound.

6. An automatically and manually operable thermally sensitive valve which is connected to a pressurized container of fire extinguishing material via a hose and which is inserted into the bottom of a flue, said valve including an enclosed sleeve comprising a forward end and a rearward end, a grooved fusible disk at the forward end of said sleeve, a retaining plug behind said disk and a plunger which extends through the rearward end of said sleeve, communicating with the exterior of said valve.

7. The valve of claim 6 wherein when said plunger is forced inward by an operator, said plunger pushes against said retaining plug which in turn forces said fusible disk into said flue allowing fire extinguishing material to flow through said valve to extinguish said fire.

8. The valve of claim 6 wherein said fusible disk melts at a predetermined temperature, said valve is automatically opened, allowing fire extinguishing material to flow through said valve to extinguish a fire within said flue.

* * * * *

UNITED STATES PATENT AND TRADEMARK OFFICE

CERTIFICATE OF CORRECTION

PATENT NO. : 4,997,046

DATED : March 5, 1991

INVENTOR(S) : Harry A. Evans, III

It is certified that error appears in the above—identified patent and that said Letters Patent is hereby corrected as shown below:

On the title page, Assignee should be listed as "Harry A. Evans, Jr.".

Signed and Sealed this

Twenty-fifth Day of August, 1992

*Attest:*

DOUGLAS B. COMER

*Attesting Officer*

*Acting Commissioner of Patents and Trademarks*